US009191741B1

(12) United States Patent
Brusniak

(10) Patent No.: US 9,191,741 B1
(45) Date of Patent: Nov. 17, 2015

(54) VARIABLE APERTURE PHASED ARRAY

(75) Inventor: Leon Brusniak, Lynnwood, WA (US)

(73) Assignee: THE BOEING COMPANY, Chicago, IL (US)

( * ) Notice: Subject to any disclaimer, the term of this patent is extended or adjusted under 35 U.S.C. 154(b) by 1674 days.

(21) Appl. No.: 12/536,139

(22) Filed: Aug. 5, 2009

(51) Int. Cl.
*H04R 3/00* (2006.01)

(52) U.S. Cl.
CPC ..... *H04R 3/005* (2013.01); *H04R 2201/403* (2013.01)

(58) Field of Classification Search
CPC ..... H04R 1/04; H04R 1/22; H04R 1/38; H04R 1/222; H04R 1/342; H04R 1/406; H04R 3/00; H04R 3/005; H04R 3/04; H04R 3/10; H04R 2201/401; H04R 2201/403; H04R 25/407
USPC ..... 381/71.1–71.14, 94.1–94.9, 92, 87, 381/332–336, 91, 122, 355–366; 181/175, 181/210
See application file for complete search history.

(56) References Cited

U.S. PATENT DOCUMENTS

| | | | | |
|---|---|---|---|---|
| 3,736,557 | A * | 5/1973 | Brynk | 367/120 |
| 3,781,782 | A * | 12/1973 | Scott et al. | 367/126 |
| 6,205,224 | B1 | 3/2001 | Underbrink | |
| 6,757,394 | B2 * | 6/2004 | Matsuo | 381/92 |
| 7,123,548 | B1 | 10/2006 | Uzes | |

OTHER PUBLICATIONS

U.S. Appl. No. 12/109,791, filed Apr. 25, 2008, Underbrink et al.
"Head Visor—System for Online Localization of Sound Sources in Real Time", 1 page, retrieved Aug. 5, 2009 http://www.head-acoustics.de/eng/nvh_head-visor.htm.
Brusniak et al., "Acoustic Imaging of Aircraft Noise Sources Using Large Aperture Phased Arrays", AIAA 2006-2715, 12th AIAA/CEAS Aeroacoustics Conference, May 2006, Cambridge, MA, pp. 1-20.
Mabe et al., "Boeing's Variable Geometry Chevron, Morphing Aerostructure for Jet Noise Reduction", AIAA 2006-2142, 47th AIAA/ASME/ASCE/AHS/ASC Structures, Structural Dynamics, and Materials Conference, May 2006, Newport RI, pp. 1-19.
Calkins et al., "Variable Geometry Chevrons for Jet Noise Reduction", AIAA 2006-2546, 12th AIAA/CEAS Aeroacoustics Conference, May 2006, Cambridge MA, pp. 1-11.
Herkes et al., "The Quiet Technology Demonstrator Program Flight Validation of Airplane Noise-Reduction Concepts", AIAA 2006-2720, 12th AIAA/CEAS Aeroacoustics Conference, May 2006, Cambridge MA, pp. 1-9.
Brooks et al., "A Deconvolution Approach for the Mapping of Acoustic Sources (DAMAS) Determined from Phased Microphone Arrays", AIAA 2004-2954, 10th AIAA/CEAS Aeroacoustics Conference, Manchester, UK, May 2004, pp. 1-18.
(Continued)

*Primary Examiner* — Xu Mei
(74) *Attorney, Agent, or Firm* — Yee & Associates, P.C.

(57) ABSTRACT

The different advantageous embodiments may provide an apparatus that may comprise a support structure, a number of acoustic sensors, and a controller. The number of acoustic sensors may be coupled to the support structure. The controller may be configured to control the support structure to change the spatial distribution of the number of acoustic sensors.

26 Claims, 6 Drawing Sheets

(56) References Cited

OTHER PUBLICATIONS

"High Channel Count Systems Architecture for Noise and Vibration Measurements", National Instruments, Autestcon 2007, pp. 1-16.

Underbrink et al., "Aeroacoustic Phased Array Data Acquisition and Data Reduction Systems", Boeing, 2001 Test Data Acquisition & Control Systems Conference, Jun. 2001, pp. 1-11.

"Quiet Technology Research for Low Noise Airframes" NASA-Gulfstream Partnership, Fundamental Aeronautics 2007 Annual Meeting, Oct. 2007, pp. 1-31.

Lu, "An Empirical Model for Prediction of Coaxial Jet Noise in Ambient Flow", AIAA 10$^{th}$ Aeroacoutics Conferece, Jul. 1986, Seattle WA, pp. 1-9.

Remillieux et al., "Novel Kevlar-Walled Wind Tunnel for Aeroacoustic Testing of a Landing Gear", AIAA journal, vol. 46, No. 7, Jul. 2008, American Institute of Aeronautics and Astronautics, Reston, VA, ETATS-UNIS, 1963, pp. 1631-1639.

* cited by examiner

VARIABLE APERTURE PHASED ARRAY

BACKGROUND INFORMATION

1. Field

The present disclosure relates generally to an apparatus for acquiring acoustic data and more particularly to a method for changing capabilities of an acoustic array.

2. Background

The analysis of noise and the sources or causes of noise may be performed to understand the physics behind the noise generation. For example, an analysis may be performed to identify where the noise is coming from. This type of analysis may be performed in the testing of devices. For example, noise data may be collected for an aircraft engine, such as a jet engine. The noise data collected may be analyzed to determine what components within, and exterior to the jet engine contribute to the noise. These different components may also be referred to as component noise sources.

Currently, arrays of microphones may be used to collect noise data. This noise data may be processed to produce a "picture" of where the noise is coming from, and to determine the intensity of the radiated noise. In obtaining this data, microphones may be placed at different locations. With current array designs, hundreds or thousands of microphone locations may be needed to cover all the sound propagation paths formed by connecting hundreds of candidate noise source locations to dozens of measurement points of interest.

The currently used methods for obtaining noise using arrays of microphones may be limited to the array size or location. Further, the current methodologies may collect noise information with limited numbers of microphones. The microphones may be placed at positions at which noise data may be collected. This type of collection may result only in noise data being collected for a limited number of emission angles.

Therefore, it would be advantageous to have a method and apparatus that overcomes one or more of the issues described above as well as possibly other issues.

SUMMARY

One or more of the different advantageous embodiments provide an apparatus comprising a support structure, a number of acoustic sensors, and a controller. The number of acoustic sensors is coupled to the support structure. The controller is configured to control the support structure to change the spatial distribution of the number of acoustic sensors.

One or more of the different advantageous embodiments may further provide a method for acoustic testing. A noise may be detected using an array. Commands may be received to change a size of the array based on the noise detected. The size of the array may be physically changed.

One or more of the different advantageous embodiments may further provide a method for acoustic sensor distribution. Commands may be received to change a pattern of an array to a selected pattern from a number of patterns. The shape of a support structure may be physically changed to achieve the selected pattern for the array.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
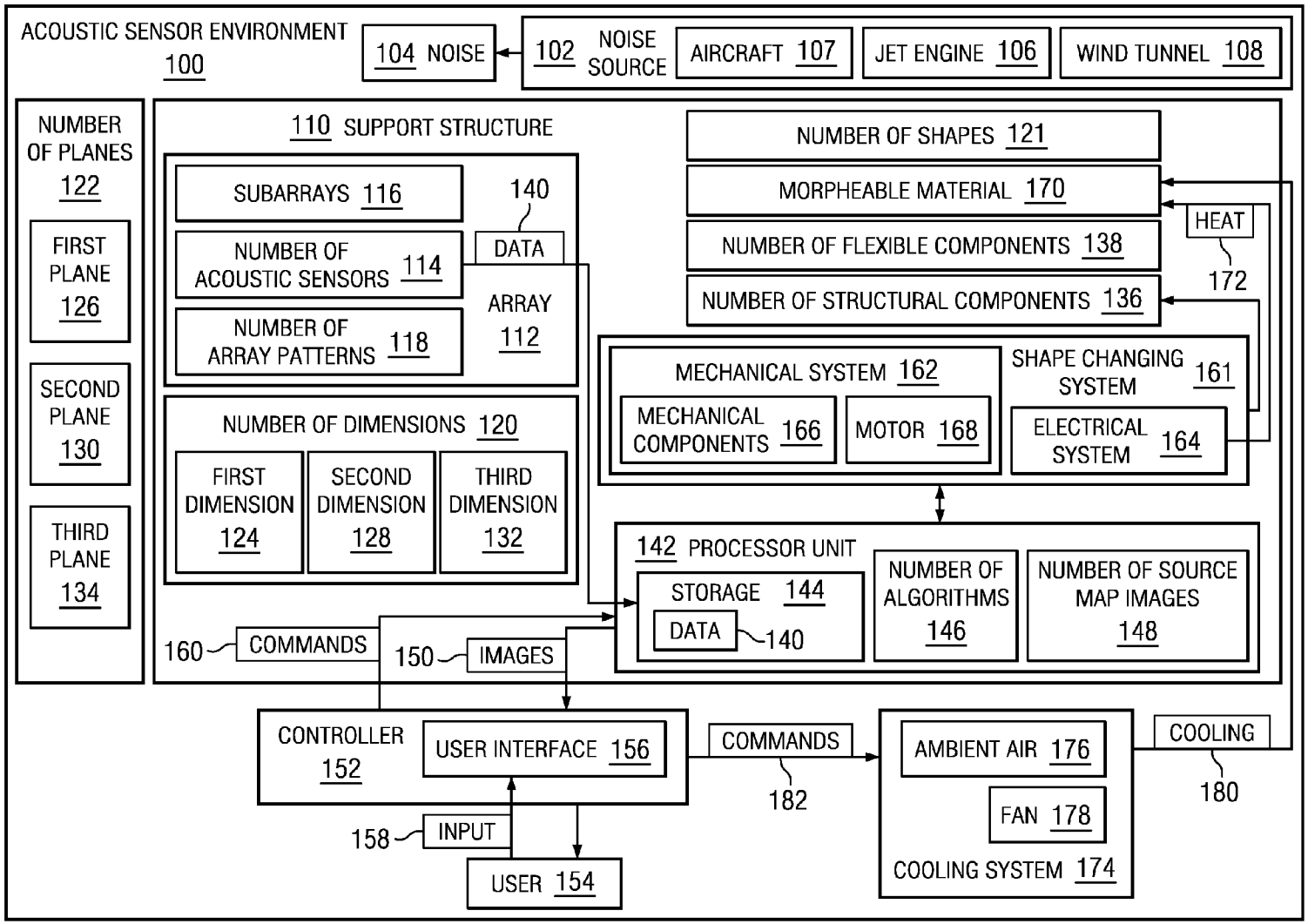
FIG. 1 is an illustration of an acoustic sensor environment in which an advantageous embodiment may be implemented.

The different advantageous embodiments recognize and take into account a number of different considerations. For example, the different advantageous embodiments recognize and take into account that currently used acoustic phased arrays may consist of microphones attached to an inflexible support structure. An inflexible support structure may be a skeleton frame or holes drilled into a flat plate, for example. Spatial resolution capabilities of phased arrays may be determined by the spatial distribution of the microphones. When microphones are attached to an inflexible support structure, the spatial resolution capabilities of the microphones may be fixed, and may not be changed. Spatial resolution capabilities may refer to the ability to distinguish between multiple noise sources.

The different advantageous embodiments further recognize and take into account that current parameters driving array noise source spatial resolution capabilities may include the number of microphones used and the relative distribution of these microphones in space. The relative distribution may refer to the physical extent, such as height, width, and depth, of the microphones in space. At low temporal frequencies, spatial resolution may be improved in proportion to an increase in the physical extent of an array. At high temporal frequencies, the ability to minimize acoustic wave decorrelation effects may be improved in proportion to how densely the microphones may be packed.

The different advantageous embodiments further recognize and take into account that the microphones that may be used may be expensive, which may limit the number of microphones available for a particular array. Current methods may strike a balance between the array spatial resolution capabilities and the number of available microphones in order to minimize cost. As a result, constraints on the number of available microphones may directly impact the range of array spatial resolution capabilities.

The different advantageous embodiments further recognize and take into account that current methods of moving microphones from one location to another location may be time consuming and cost-prohibitive. Additional expense may be incurred during the down-time that may be required for repositioning the microphones and recalibrating the array after each repositioning. This process may add a restriction on the ability to perform acoustic testing.

Thus, one or more of the different advantageous embodiments may provide an apparatus comprising a support structure, a number of acoustic sensors, and a controller. The number of acoustic sensors are coupled to the support structure. The controller is configured to control the support structure to change the spatial distribution of the number of acoustic sensors.

One or more of the different advantageous embodiments may further provide a method for acoustic testing. A noise may be detected using an array. Commands may be received to change a size of the array based on the noise detected. The size of the array may be physically changed.

One or more of the different advantageous embodiments may further provide a method for acoustic sensor distribution. Commands may be received to change a pattern of an array to a selected pattern from a number of patterns. The shape of a support structure may be physically changed to achieve the selected pattern for the array.

One or more of the different advantageous embodiments may provide a phased array with improved resolution and/or capabilities by allowing for a physical change in the size of the array, which in turn changes the spatial locations of the microphones in the array. High frequency decorrelation may be reduced by distributing the fixed number microphones in an array more closely together through physical change of the shape of the array. The utilization of shape memory alloy materials may further provide for a physically variable support structure that increases the spatial resolution capabilities of an acoustic array. The locations of the microphones in an acoustic array may be varied relative to each other. Additionally, fewer microphones may be used to achieve increased range of spatial resolution capabilities.

With reference now to the figures and in particular with reference to FIG. 1, an illustration of an acoustic sensor environment is depicted in which an advantageous embodiment may be implemented. Acoustic sensor environment 100 may be any type of environment in which noise and/or other acoustic data are detected. Acoustic sensor environment 100 may include, for example, without limitation, an environment including an aircraft, an environment including both open and closed test section wind tunnels, and/or any other type of suitable environment.

In these illustrative examples, acoustic sensor environment 100 may include noise source 102, which may generate noise 104. In these examples, noise source 102 may take various forms. For example, without limitation, noise source 102 may be jet engine 106. In another illustrative example, noise source 102 may be, for example, without limitation, aircraft 107. In yet another illustrative example, noise source 102 may be, for example, without limitation, wind tunnel 108, and/or a device within wind tunnel 108. Of course, noise source 102 may take various forms. Other examples of noise sources may include, for example, without limitation, a train, a submarine, a water vehicle, a car, a bus, a stretch of highway with traffic, a production facility, a building, and/or some other structure or device that may generate noise. Further, noise source 102 also may be an organic and/or living noise source. For example, noise source 102 also may be, for example, without limitation, a crowd of people, a herd of cattle, noise from sea mammals, and/or some other suitable noise source.

Acoustic sensor environment 100 may include support structure 110. Support structure 110 may be a physically variable support structure that is configured to change shape for array 112. Array 112 may include number of acoustic sensors 114, subarrays 116, and number of array patterns 118. A number as used herein refers to one or more items. For example, number of acoustic sensors 114 means one or more acoustic sensors. In the illustrative examples, number of acoustic sensors 114 may be any type of sensor for detecting noise 104. For example, without limitation, number of acoustic sensors 114 may be a number of microphones. Number of acoustic sensors 114 may be selected and/or grouped as subarrays 116. Subarrays 116 may refer to a portion of number of acoustic sensors 114, for example. Array 112 may be, for example, without limitation, an acoustic phased array. Number of array patterns 118 may be any type of distribution of number of acoustic sensors 114 within array 112.

Array 112 may include number of acoustic sensors 114 associated with support structure 110 in such a way that a change in a physical location of number of acoustic sensors 114 with respect to each other within array 112 occurs in response to support structure 110 changing shape in number of dimensions 120. As used herein, a first component may considered to be associated with a second component by being secured to the second component, bonded to the second component, fastened to the second component, and/or connected to the second component in some other suitable manner. The first component may also be considered to be associated with the second component by being formed as part of and/or an extension of the second component.

Support structure 110 may be configured to physically change a size of array 112 and adapt in number of dimensions 120. Support structure 110 may be capable of achieving number of shapes 121 in the process of changing a size of array 112 and/or adapting in number of dimensions 120. The size of array 112 may correspond to the spatial resolution capabilities of array 112 for a given frequency, for example. When support structure 110 physically changes a size of array 112 and/or adapts in number of dimensions 120, array 112 may achieve number of array patterns 118.

Number of dimensions 120 may include, for example, without limitation, first dimension 124, second dimension 128, third dimension 132, and/or any other suitable dimension in time and/or space. Number of dimensions 120 may correspond to number of planes 122 in space, for example. Support structure 110 may be configured to physically adapt array 112 in first dimension 124 by extending and/or retracting array 112 along first plane 126. First plane 126 may be, for example, without limitation, a one dimensional line. Support structure 110 may physically adapt array 112 in second dimension 128 by expanding and/or retracting array 112 across second plane 130. Second plane 130 may be, for example, without limitation, two dimensions of a surface, such as length and width. Support structure 110 may physically adapt array 112 in third dimension 132 by expanding and/or retracting array 112 across third plane 134. Third plane 134 may be, for example, without limitation, three dimensions in space, such as length, width, and depth.

In an illustrative example, if noise source 102 is implemented as jet engine 106, support structure 110 may physically adapt array 112 in first dimension 124. Spatial resolution of array 112 may be limited to resolve for noise 104 on a one dimensional line, such as along the axis of jet engine 106, for example. As used herein, to resolve for noise means to be able to separately distinguish spatially separated noise sources that are located within the same region of interest but are not co-located. For example, if noise is radiating from both the inlet and exhaust of a jet engine, a well designed array will be able to separately determine the locations of these two noise sources, whereas a poorly designed array would not be able to distinguish between the two noise sources. In this example, the physical adaptation of array 112 may be, without limitation, expanding support structure 110 across the one dimensional line in such a way that number of acoustic sensors 114 achieve a spatial distribution pattern that extends number of acoustic sensors 114 along the axis of jet engine 106.

In another illustrative example, to resolve for noise 104 from a noise source of aircraft 107, for example, support structure 110 may be required to physically adapt array 112 in second dimension 128 in order to resolve for length and width of noise emitted by an aircraft. In this example, the physical adaptation of array 112 may be, without limitation, expanding support structure 110 across a length and height associated with aircraft 107 in order to achieve a spatial distribution pattern for number of acoustic sensors 114 that is two dimensional. The examples given are for illustrative purposes only and do not limit the advantageous embodiments in any way. The selection of number of dimensions 120 may be application dependent and may vary for a given environment, noise source, and/or application. Additionally, number of shapes 121 may be selected to physically transform array 112 independent from a consideration of number of dimensions 120.

In one advantageous embodiment, support structure 110 may include number of structural components 136 and number of flexible components 138. Number of structural components 136 may be any type of physical subcomponents of support structure 110, such as, without limitation, rods, tubes, arms, bars, legs, posts, crossbars, racks, nets, trellis, and/or any other suitable structural subcomponent. Number of structural components 136 may be connected together by number of flexible components 138. Number of flexible components 138 may be, without limitation, ball-and-socket joints, tracks along which a number of structural components 136 may travel, rails, springs, hinges, pulleys, cables, levers, ratcheting devices, and/or any other suitable joining element. Number of flexible components 138 may provide degrees of freedom and range of motion to number of structural components 136 and support structure 110.

Number of acoustic sensors 114 of array 112 may detect noise 104 and may generate data 140. Number of acoustic sensors 114 may send data 140 to processor unit 142. Data 140 may be sent over a network using, for example, without limitation, wires, fiber optic cables, wireless transmission links, a mixture of transmission media, and/or any other suitable network components.

Data 140 may be received by processor unit 142 and stored within storage 144. Data 140 may provide the potential to create images of noise 104 over different periods of time. Processor unit 142 may include number of algorithms 146. Number of algorithms 146 may use data 140 to generate number of source map images 148. Number of source map images 148 may be sent by processor unit 142 as images 150 to controller 152.

Controller 152 may be any type of computer system and/or data processing system. Controller 152 may be configured to interface with user 154. User 154 may be, for example, without limitation, a human user and/or a program. Controller 152 may include user interface 156. User interface 156 may be configured to display images 150 from processor 142 for viewing by user 154. User interface 156 may also be configured to receive input 158 from user 154 and generate commands 160. Commands 160 may be sent by controller 152 to processor unit 142. Commands 160 may be, for example, without limitation, instructions to change a size of array 112, selection of number of array patterns 118 for array 112, selection of number of shapes 121 for support structure 110, instructions to control shape changing system 161, and/or any other suitable instructions.

Shape changing system 161 changes the shape of support structure 110. Shape changing system 161 includes mechanical system 162 and electrical system 164. Mechanical system 162 may include mechanical components 166 for controlling movement of number of structural components 136. Mechanical components 166 may include, for example, without limitation, actuators, motors, levers, cranks, and/or any other suitable mechanical component. For example, one implementation of mechanical components 166 may be motor 168. Motor 168 may control movement of number of structural components 136, for example.

Electrical system 164 may be configured to activate morpheable material 170. Electrical system 164 may include heat generating elements coupled to morpheable material 170. Electrical system 164 may include, for example, without limitation, electrical circuits for driving an application of heat 172 to morpheable material 170. Morpheable material 170 may be, for example, without limitation, shape memory alloy materials. Shape memory alloy materials may be deformed through the application of heat and/or cooling. Shape memory alloy materials may have a memory of their original shape. Heating and/or cooling may allow for the capability of shape memory allow materials to expand and/or contract support structure 110. While heat 172 may be applied using electrical system 164, cooling may be applied using cooling system 174.

Cooling system 174 may include, for example, without limitation, cooling elements directed towards morpheable material 170. These cooling elements may be, for example, without limitation, ambient air 176, fan 178, and/or any other suitable cooling elements. Cooling system 174 may direct an application of cooling 180 to morpheable material 170, which may maintain a current deformation of morpheable material 170 following an application of heat 172 from electrical system 164. Cooling system 174 may receive commands 182 from controller 152, which trigger cooling system 174 to direct cooling 180 towards morpheable material 170.

The illustration of acoustic sensor environment 100 in FIG. 1 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, support structure 110 may be implemented without morpheable material 170 and/or electrical system 164, relying upon number of structural components 136, number of flexible components 138, and mechanical system 162 for shape deformation and physical adaptation into number of dimensions 120. In another advantageous embodiment, support structure 110 may be implemented without number of structural components 136, number of flexible components 138, and mechanical system 162, relying upon morpheable material 170, and electrical system 164, and cooling system 174, for shape deformation and physical adaptation. In yet another advantageous embodiment, support structure 110 may be implemented in a hybrid approach using both mechanical elements and shape memory alloy materials to achieve number of shapes 121 and number of array patterns 118, and to adapt into number of dimensions 120.

Figure 2:
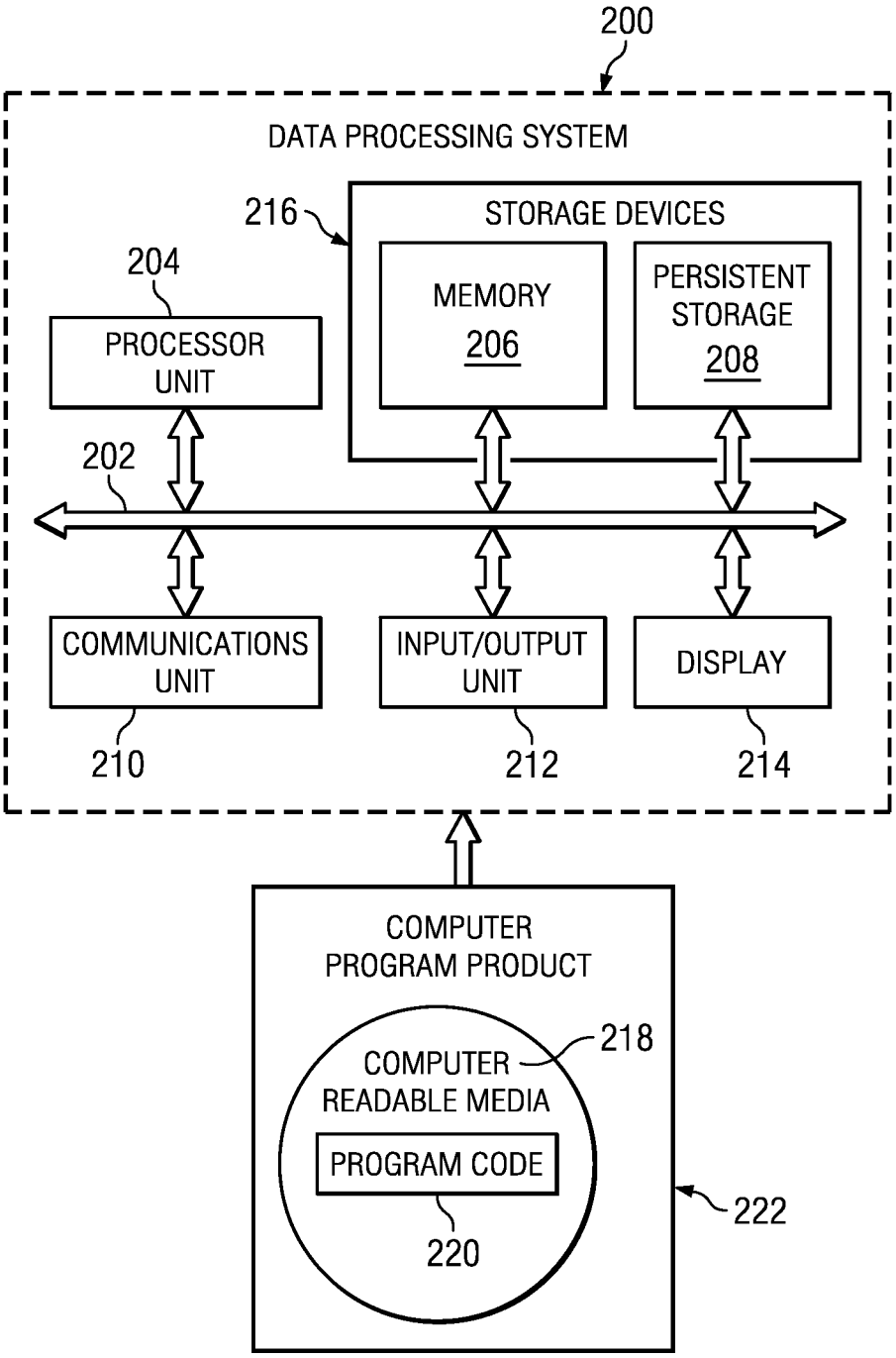
FIG. 2 is an illustration of a data processing system in accordance with an advantageous embodiment.

With reference now to FIG. 2, an illustration of a data processing system is depicted in accordance with an advantageous embodiment. Data processing system 200 may be used to implement different computers and data processing systems within an acoustic sensor environment, such as controller 152 and processor unit 142 in acoustic sensor environment 100 in FIG. 1.

In this illustrative example, data processing system 200 includes communications fabric 202, which provides communications between processor unit 204, memory 206, persistent storage 208, communications unit 210, input/output (I/O) unit 212, and display 214. Depending on the particular implementation, different architectures and/or configurations of data processing system 200 may be used.

Processor unit 204 serves to execute instructions for software that may be loaded into memory 206. Processor unit 204 may be a set of one or more processors or may be a multiprocessor core, depending on the particular implementation. Further, processor unit 204 may be implemented using one or more heterogeneous processor systems in which a main processor is present with secondary processors on a single chip. As another illustrative example, processor unit 204 may be a symmetric multi-processor system containing multiple processors of the same type.

Memory 206 and persistent storage 208 are examples of storage devices 216. A storage device may be any piece of hardware that may be capable of storing information, such as, for example, without limitation, data, program code in functional form, and/or other suitable information either on a temporary basis and/or a permanent basis. Memory 206, in these examples, may be, for example, a random access memory or any other suitable volatile or non-volatile storage device. Persistent storage 208 may take various forms depending on the particular implementation. For example, persistent storage 208 may contain one or more components or devices. For example, persistent storage 208 may be a hard drive, a flash memory, a rewritable optical disk, a rewritable magnetic tape, or some combination of the above. The media used by persistent storage 208 also may be removable. For example, a removable hard drive may be used for persistent storage 208.

Communications unit 210, in these examples, provides for communications with other data processing systems or devices. In these examples, communications unit 210 may be a network interface card. Communications unit 210 may provide communications through the use of either or both physical and wireless communications links.

Input/output unit 212 allows for input and output of data with other devices that may be connected to data processing system 200. For example, input/output unit 212 may provide a connection for user input through a keyboard, a mouse, and/or some other suitable input device. Further, input/output unit 212 may send output to a printer. Display 214 provides a mechanism to display information to a user.

Instructions for the operating system, applications and/or programs may be located in storage devices 216, which are in communication with processor unit 204 through communications fabric 202. In these illustrative examples the instructions are in a functional form on persistent storage 208. These instructions may be loaded into memory 206 for execution by processor unit 204. The processes of the different embodiments may be performed by processor unit 204 using computer implemented instructions, which may be located in memory, such as memory 206.

These instructions are referred to as program code, computer usable program code, or computer readable program code that may be read and executed by a processor in processor unit 204. The program code in the different embodiments may be embodied on different physical or tangible computer readable media, such as memory 206 or persistent storage 208.

Program code 220 may be located in a functional form on computer readable media 218 that may be selectively removable and may be loaded onto or transferred to data processing system 200 for execution by processor unit 204. Program code 220 and computer readable media 218 form computer program product 222 in these examples. In one example, computer readable media 218 may be in a tangible form, such as, for example, an optical or magnetic disc that may be inserted or placed into a drive or other device that may be part of persistent storage 208 for transfer onto a storage device, such as a hard drive that may be part of persistent storage 208. In a tangible form, computer readable media 218 also may take the form of a persistent storage, such as a hard drive, a thumb drive, or a flash memory that may be connected to data processing system 200. The tangible form of computer readable media 218 may also be referred to as computer recordable storage media. In some instances, computer readable media 218 may not be removable.

Alternatively, program code 220 may be transferred to data processing system 200 from computer readable media 218 through a communications link to communications unit 210 and/or through a connection to input/output unit 212. The communications link and/or the connection may be physical or wireless in the illustrative examples. The computer readable media also may take the form of non-tangible media, such as communications links or wireless transmissions containing the program code.

In some illustrative embodiments, program code 220 may be downloaded over a network to persistent storage 208 from another device or data processing system for use within data processing system 200. For instance, program code stored in a computer readable storage medium in a server data processing system may be downloaded over a network from the server to data processing system 200. The data processing system providing program code 220 may be a server computer, a client computer, or some other device capable of storing and transmitting program code 220.

The different components illustrated for data processing system 200 are not meant to provide architectural limitations to the manner in which different embodiments may be implemented. The different illustrative embodiments may be implemented in a data processing system including components in addition to or in place of those illustrated for data processing system 200. Other components shown in FIG. 2 can be varied from the illustrative examples shown. The different embodiments may be implemented using any hardware device or system capable of executing program code. As one example, the data processing system may include organic components integrated with inorganic components and/or may be comprised entirely of organic components excluding a human being. For example, a storage device may be comprised of an organic semiconductor.

As another example, a storage device in data processing system 200 may be any hardware apparatus that may store data. Memory 206, persistent storage 208 and computer readable media 218 are examples of storage devices in a tangible form.

In another example, a bus system may be used to implement communications fabric 202 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 206 or a cache such as found in an interface and memory controller hub that may be present in communications fabric 202.

Figure 3:
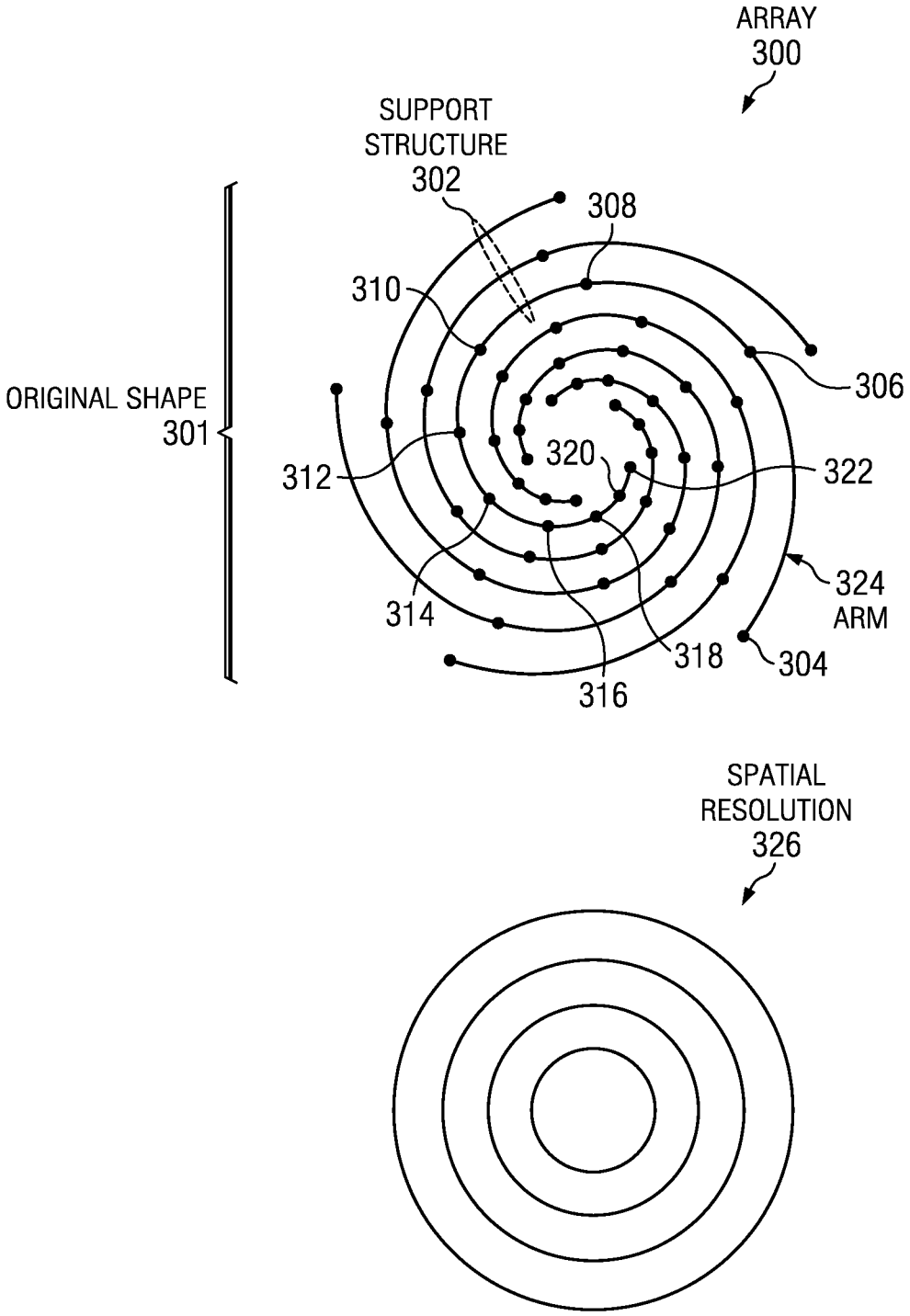
FIG. 3 is an illustration of an array in accordance with an advantageous embodiment.

With reference now to FIG. 3, an illustration of an array is depicted in accordance with an advantageous embodiment. Array 300 may be an example of one implementation of array 112 in FIG. 1.

Array 300 is in original shape 301 supported by support structure 302. Support structure 302 may be an example of one implementation of support structure 110 in FIG. 1. Support structure 302 may be an example of one implementation of support structure 110 in an undeformed, or original, shape. Original shape 301 may be, for example, without limitation, an undeformed shape of support structure 302.

Array 300 includes a number of microphones including microphones 304, 306, 308, 310, 312, 314, 316, 318, and 320. Microphones 304, 306, 308, 310, 312, 314, 316, 318, and 320 may be an example of a subarray of acoustic sensors, such as a subarray of subarrays 116 for number of acoustic sensors 114 in FIG. 1. Microphones 304, 306, 308, 310, 312, 314, 316, 318, and 320 may be distributed along arm 324 of support structure 302. Arm 324 may be one of a number of arms of support structure 302. Each arm of support structure 302 may have a number of microphones similar to microphones 304, 306, 308, 310, 312, 314, 316, 318, and 320, of arm 324, for example.

Original shape 301 of support structure 302, and the distribution pattern of the microphones of array 300 as a result of original shape 301, may provide spatial resolution 326. Original shape 301 may be an example of a depiction of a densely packed microphone array. The microphone density depicted in array 300 may by an example of the greatest density that can be physically achieved by original shape 301 of support structure 302. The aperture size of array 300 may provide measurements at a given temporal frequency that may result in spatial resolution 326. Increasing the aperture size of array 300 may improve spatial resolution 326 so that array 300 may increasingly distinguish between multiple noise sources which may be present, as may be depicted by spatial resolution 403 in FIG. 4, and spatial resolution 503 in FIG. 5.

The illustration of array 300 in FIG. 3 is not meant to imply physical or architectural limitations to the manner in which different advantageous embodiments may be implemented. Other components in addition to and/or in place of the ones illustrated may be used. Some components may be unnecessary in some advantageous embodiments. One or more of these components may be combined and/or divided into different components when implemented in different advantageous embodiments.

For example, additional or fewer microphones may be implemented in array 300. In another advantageous embodiments, support structure 302 may have additional or fewer arms. In yet another advantageous embodiment, support structure 302 may be implemented with rods that run parallel and/or perpendicular rather than in a spiral pattern, for example.

Figure 4:
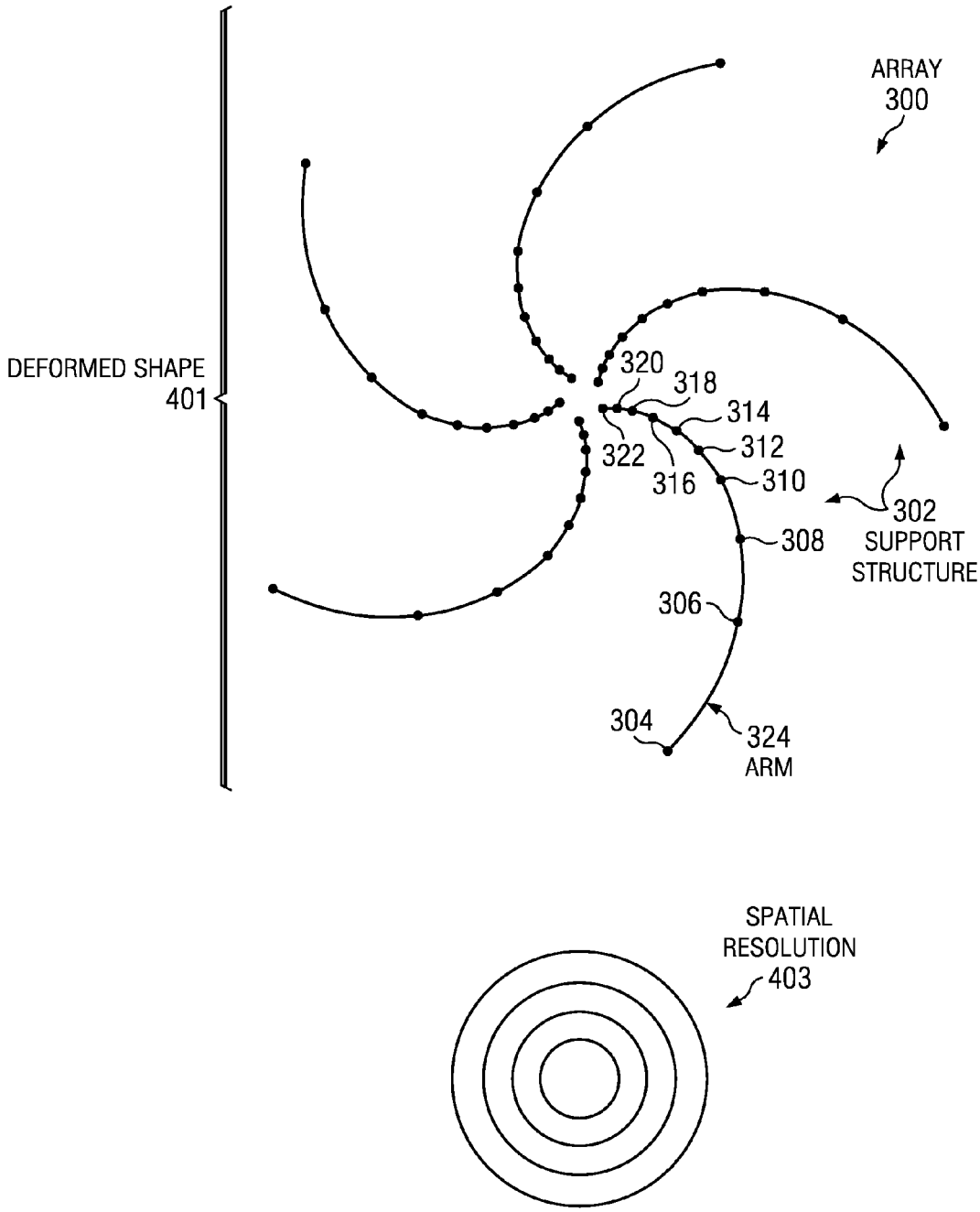
FIG. 4 is an illustration of an array in accordance with an advantageous embodiment.

With reference now to FIG. 4, an illustration of an array is depicted in accordance with an advantageous embodiment. Array 300 may be depicted here in deformed shape 401.

Array 300 is supported by support structure 302. Support structure 302 may be an example of a physical adaptation of support structure 302 from original shape 301 in FIG. 3 to deformed shape 401.

Array 300 includes a number of microphones including microphones 304, 306, 308, 310, 312, 314, 316, 318, 320, and 322, which may be distributed along arm 324 of support structure 302. Deformed shape 401 of support structure 302, and the distribution pattern of microphones 304, 306, 308, 310, 312, 314, 316, 318, and 320 of array 300 as a result of deformed shape 401, may provide spatial resolution 403. Deformed shape 401 may be an example of a depiction of a less densely packed microphone array than array 300 in original shape 301 in FIG. 3. Deformed shape 401 may provide an increased aperture size from that of original shape 301 for array 300, which provides increased spatial resolution 403. Array 300 may be able to distinguish between noise sources more easily in deformed shape 401 than in original shape 301 as a result of spatial resolution 403.

The illustration of array 300 in FIG. 4 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in one advantageous embodiment, deformed shape 401 of array 300 may be achieved using mechanical subcomponents and a mechanical system, such as number of structural components 136, number of flexible components 138, and mechanical system 162 of FIG. 1. In another advantageous embodiment, deformed shape 401 of array 300 may be achieved using morpheable materials in conjunction with an electrical system and/or cooling system, such as morpheable material 170, electrical system 164, and cooling system 174 of FIG. 1. In yet another advantageous embodiment, deformed shape 401 of array 300 may be achieved using a hybrid mix of both mechanical and electrical subcomponents, for example.

Figure 5:
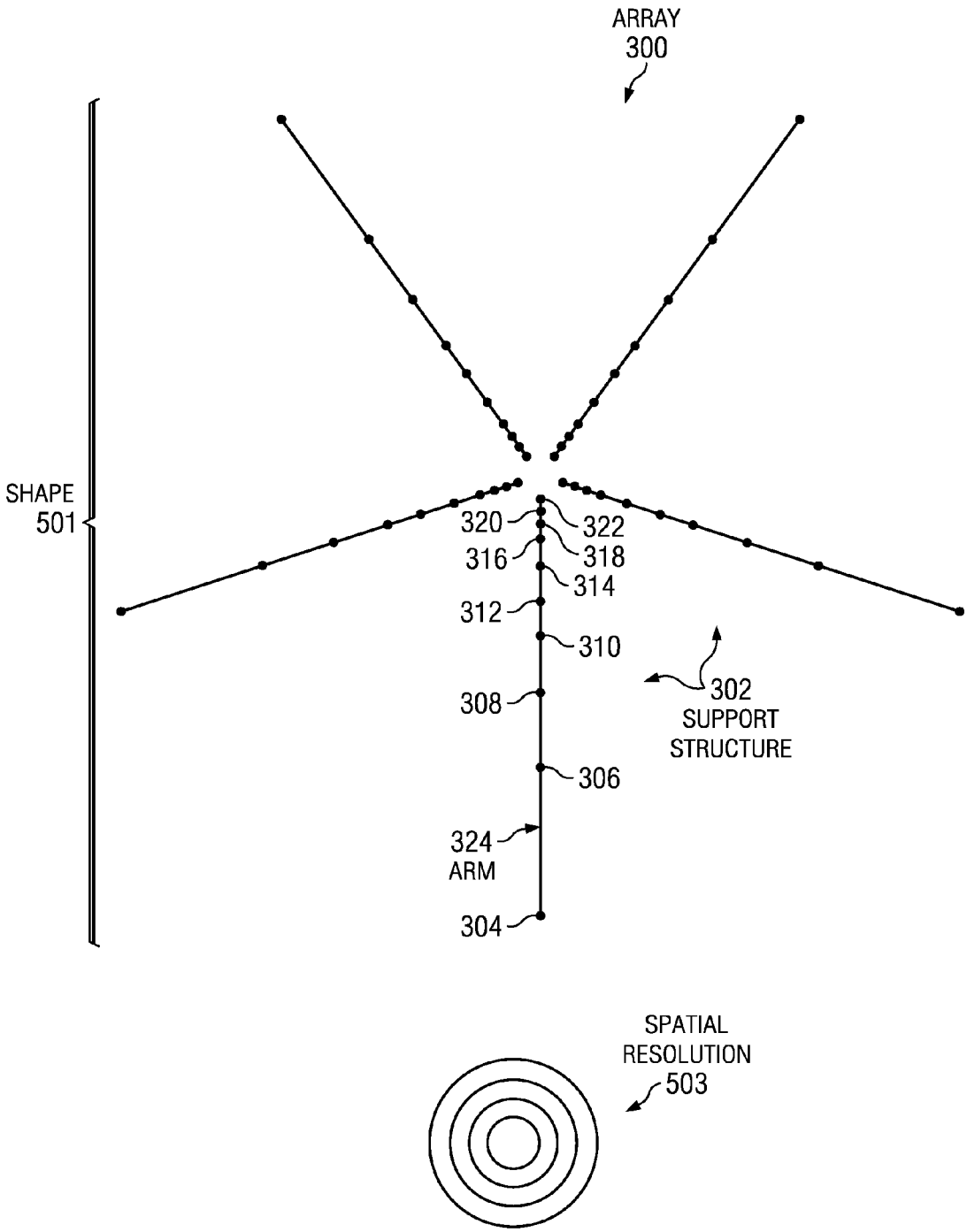
FIG. 5 is an illustration of an array in accordance with an advantageous embodiment.

With reference now to FIG. 5, an illustration of an array is depicted in accordance with an advantageous embodiment. Array 300 may be depicted here in deformed shape 501.

Array 300 is supported by support structure 302. Support structure 302 may be an example of a physical adaptation of support structure 302 from deformed shape 401 in FIG. 4 to deformed shape 501.

Array 300 includes a number of microphones including microphones 304, 306, 308, 310, 312, 314, 316, 318, and 320, which may be distributed along arm 324 of support structure 302. Deformed shape 501 of support structure 302, and the distribution pattern of microphones 304, 306, 308, 310, 312, 314, 316, 318, and 320 of array 300 as a result of deformed shape 501, may provide spatial resolution 503. Deformed shape 501 may be an example of a depiction of a least densely packed microphone array pattern for array 300. Deformed shape 501 may provide the maximum aperture size for array 300, increased from that of deformed shape 401 in FIG. 4, which provides increased spatial resolution 503. Array 300 may be able to distinguish between noise sources more easily in deformed shape 501 than in deformed shape 401 as a result of spatial resolution 503.

The illustration of array 300 in FIG. 5 is not meant to imply physical or architectural limitations to the manner in which different advantageous embodiments may be implemented. Other components in addition to and/or in place of the ones illustrated may be used. Some components may be unnecessary in some advantageous embodiments. One or more of these components may be combined and/or divided into different components when implemented in different advantageous embodiments.

For example, the deformations depicted in FIGS. 3, 4, and 5 may not be limited to one plane, such as first plane 126 in FIG. 1. A three-dimensional deformation of support structure 302 may be achieved, which may allow for a three-dimensional distribution of microphones 304, 306, 308, 310, 312, 314, 316, 318, 320, and 322. This three-dimensional distribution may allow for improved array spatial resolution capabilities in the direction normal to the plane formed by microphones of the original un-deformed array, such as array 300 in original shape 301 for example.

In another illustrative example, the desired aperture for support structure 302 may be dialed in, or remotely controlled, by a user employing a controller, such as user 154 using controller 152 in FIG. 1. The commands may be sent from the controller to a processor unit of the support structure, such as processor unit 142 of support structure 110 in FIG. 1. The processor unit may then send instructions to components of the support structure to achieve the desired deformation, resulting in a shape, and/or pattern, that achieves the desired aperture and spatial resolution capabilities for the frequencies detected.

Figure 6:
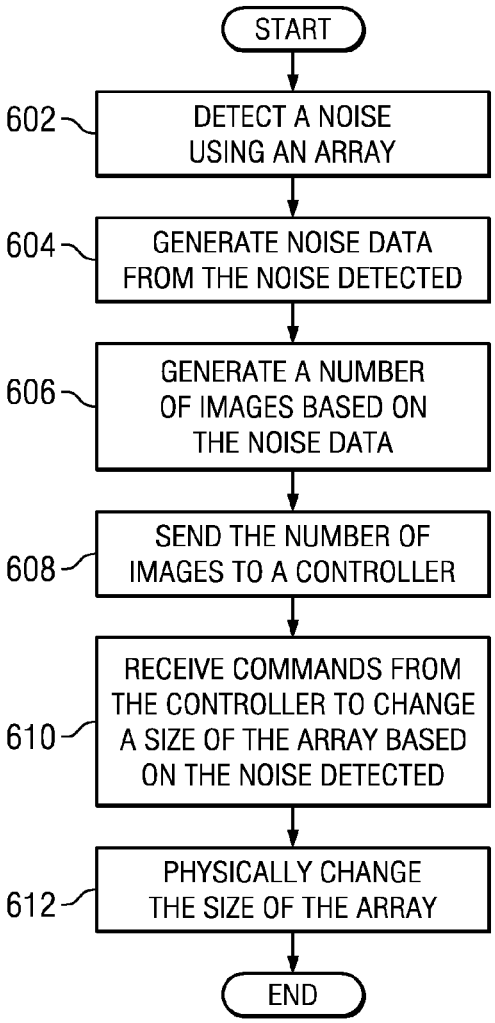
FIG. 6 is an illustration of a flowchart for a process used in acoustic testing in accordance with an advantageous embodiment.

With reference now to FIG. 6, an illustration of a flowchart for a process used in acoustic testing is depicted in accordance with an advantageous embodiment. The process in FIG. 6 may be implemented by a component such as support structure 110 using processor unit 142 in FIG. 1, for example.

The process may begin by detecting a noise using an array (operation 602). The array may be an acoustic array, such as a phased microphone array for example. The noise may be detected by one or more acoustic sensors, such as a microphone, of the array, such as array 112 in FIG. 1 for example. The process may generate noise data from the noise detected (operation 604). The process may generate a number of images based on the noise data (operation 606). The number of images may be generated using algorithms, such as number of algorithms 146 in FIG. 1, for example. The number of images may be stored by the processor unit of the support structure until sent to a controller, and/or dynamically sent to the controller as generated, for example.

The process may send the number of images to a controller (operation 608). The controller may be a remote manual device, such as a computer or handheld processing device for example. The controller may be configured to interface with a user and present the number of images to the user. Next, the process may receive commands from the controller to change a size of the array based on the noise detected (operation 610). The process may then physically change the size of the array (operation 612), with the process terminating thereafter.

The process may physically change the size of the array using mechanical components, electrical components, morpheable materials, and/or a combination of mechanical, electrical, and morpheable elements to achieve the desired size of the array.

Figure 7:
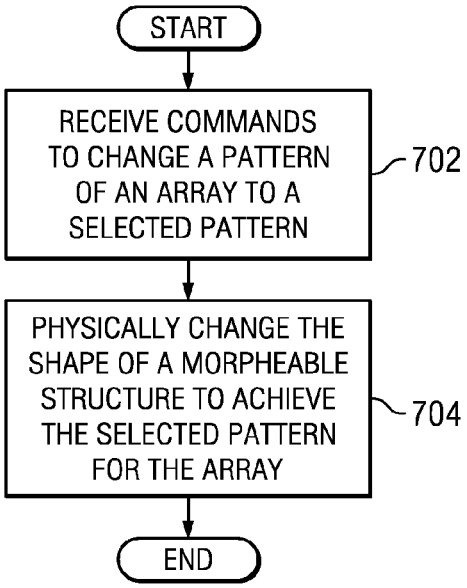
FIG. 7 is an illustration of a flowchart for a process used in acoustic sensor distribution in accordance with an advantageous embodiment.

With reference now to FIG. 7, an illustration of a flowchart for a process used in acoustic sensor distribution is depicted in accordance with an advantageous embodiment. The process in FIG. 6 may be implemented by a component such as support structure 110 using processor unit 142 in FIG. 1, for example.

The process may begin by receiving commands to change a pattern of an array to a selected pattern (operation 702). The array may be, for example, without limitation, array 112 in FIG. 1. In one illustrative example, the selected pattern may be selected by a user, such as user 154, from a number of patterns, such as number of array patterns 118 in FIG. 1. In another illustrative example, the selected pattern may be controlled by automated code of controller 152 in FIG. 1, implemented as a feedback system that uses the output from the array, such as array 112 in FIG. 1, as an input and changes the array shape based on defined requirements and parameters. The process may then physically change the shape of a support structure to achieve the selected pattern for the array (operation 704), with the process terminating thereafter.

The flowcharts and block diagrams in the different depicted embodiments illustrate the architecture, functionality, and operation of some possible implementations of apparatus and methods in different advantageous embodiments. In this regard, each block in the flowchart or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

The different advantageous embodiments further recognize and take into account that current parameters driving array resolution capabilities may include the number of microphones used and the relative distribution of these microphones in space. The relative distribution may refer to the physical extent, such as height, width, and depth, of the microphones in space. At low temporal frequencies, spatial resolution may be increased in proportion to an increase in the physical extent of an array. At high temporal frequencies, the ability to minimize acoustic wave decorrelation effects may be improved in proportion to how densely the microphones may be packed.

The different advantageous embodiments further recognize and take into account that the microphones that may be used may be expensive, which may limit the number of microphones available for a particular array. Current methods may strike a balance between the array spatial resolution capabilities and the number of available microphones in order to minimize cost. As a result, constraints on the number of available microphones may directly impact the range of array spatial resolution capabilities.

The different advantageous embodiments further recognize and take into account that current methods of moving microphones from one location to another location may be time consuming and cost-prohibitive. Additional expense may be incurred during the down-time that may be required for repositioning the microphones and recalibrating the array after each repositioning. This process may add a restriction on the ability to perform acoustic testing.

Thus, one or more of the different advantageous embodiments may provide an apparatus comprising a support structure, a number of acoustic sensors, and a controller. The number of acoustic sensors are coupled to the support structure. The controller is configured to control the support structure to change the spatial distribution of the number of acoustic sensors.

One or more of the different advantageous embodiments may further provide a method for acoustic testing. A noise may be detected using an array. Commands may be received to change a size of the array based on the noise detected. The size of the array may be physically changed.

One or more of the different advantageous embodiments may further provide a method for acoustic sensor distribution. Commands may be received to change a pattern of an array to a selected pattern from a number of patterns. The shape of a support structure may be physically changed to achieve the selected pattern for the array.

One or more of the different advantageous embodiments may provide a phased array with improved resolution by allowing for a physical change in the size of the array, which in turn changes the spatial locations of the microphones in the array. The utilization of shape memory alloy materials may further provide for a physically variable support structure that increases the spatial resolution capabilities of an acoustic array. The locations of the microphones in an acoustic array may be varied relative to each other. Additionally, fewer microphones may be used to achieve increased range of spatial resolution capabilities that would otherwise be required for a rigid non-morpheable structure.

The different advantageous embodiments can take the form of an entirely hardware embodiment, an entirely software embodiment, or an embodiment containing both hardware and software elements. Some embodiments are implemented in software, which includes but is not limited to forms, such as, for example, firmware, resident software, and microcode.

Furthermore, the different embodiments can take the form of a computer program product accessible from a computer-usable or computer-readable medium providing program code for use by or in connection with a computer or any device or system that executes instructions. For the purposes of this disclosure, a computer-usable or computer readable medium can generally be any tangible apparatus that can contain, store, communicate, propagate, or transport the program for use by or in connection with the instruction execution system, apparatus, or device.

The computer usable or computer readable medium can be, for example, without limitation an electronic, magnetic, optical, electromagnetic, infrared, or semiconductor system, or a propagation medium. Non limiting examples of a computer-readable medium include a semiconductor or solid state memory, magnetic tape, a removable computer diskette, a random access memory (RAM), a read-only memory (ROM), a rigid magnetic disk, and an optical disk. Optical disks may include compact disk-read only memory (CD-ROM), compact disk-read/write (CD-R/W) and DVD.

Further, a computer-usable or computer-readable medium may contain or store a computer readable or usable program code such that when the computer readable or usable program code is executed on a computer, the execution of this computer readable or usable program code causes the computer to transmit another computer readable or usable program code over a communications link. This communications link may use a medium that is, for example, without limitation, physical or wireless.

A data processing system suitable for storing and/or executing computer readable or computer usable program code will include one or more processors coupled directly or indirectly to memory elements through a communications fabric, such as a system bus. The memory elements may include local memory employed during actual execution of the program code, bulk storage, and cache memories which provide temporary storage of at least some computer readable or computer usable program code to reduce the number of times code may be retrieved from bulk storage during execution of the code.

Input/output or I/O devices can be coupled to the system either directly or through intervening I/O controllers. These devices may include, for example, without limitation to keyboards, touch screen displays, and pointing devices. Different communications adapters may also be coupled to the system to enable the data processing system to become coupled to other data processing systems or remote printers or storage devices through intervening private or public networks. Non-limiting examples are modems and network adapters, which are just a few of the currently available types of communications adapters.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a structure configured to support an array of acoustic sensors, the structure comprising: a shape, and a component configured to change in a number of dimensions from a first shape to a deformed shape;

the array of acoustic sensors connected to the structure, the array configured such that the deformed shape changes a physical location of a first acoustic sensor on the component with respect to a second acoustic sensor on the component; and a controller in communication with the array of acoustic sensors, wherein the controller is configured to receive data from the array of acoustic sensors and to control a shape changing system.

2. The apparatus of claim 1 further comprising:

the shape changing system associated with the structure, wherein the shape changing system is configured to cause the structure to change the shape in the number of dimensions.

3. The apparatus of claim 1, wherein the change to the deformed shape changes at least one of: an aperture size for the array of acoustic sensors, and a spatial resolution for the array of acoustic sensors.

4. The apparatus of claim 1, wherein the shape of the structure is changed in the number of dimensions during an acoustic test.

5. The apparatus of claim 1, wherein the structure is comprised of a number of structural components and a number of flexible components.

6. The apparatus of claim 5, wherein the number of structural components include at least one of rods, tubes, arms, bars, legs, posts, crossbars, racks, nets, and trellis.

7. The apparatus of claim 5, wherein the number of flexible components include at least one of ball-and-socket joints, tracks, rails, springs, hinges, pulleys, cables, levers, and ratcheting devices.

8. The apparatus of claim 1, wherein the structure is comprised of a morphable material.

9. The apparatus of claim 8, wherein the morphable material is a shape memory alloy material.

10. The apparatus of claim 1, wherein the structure is comprised of at least one of a number of structural components, a number of flexible components, and a morphable material.

11. An apparatus comprising:

a support structure;

a number of acoustic sensors coupled to the support structure; and a controller configured to control the support structure to change a physical spatial distribution such that a distance between a first acoustic sensor and a second acoustic sensor, in the number of acoustic sensors, changes and the number of acoustic sensors comprise a capacity to distinguish a noise source after the change in the distance between the first acoustic sensor and the second acoustic sensor.

12. The apparatus of claim 11, wherein the number of acoustic sensors form an array.

13. The apparatus of claim 12, wherein the support structure is configured to physically change a size of the array.

14. The apparatus of claim 11, wherein the support structure is configured to adapt in a number of dimensions.

15. The apparatus of claim 11, wherein the controller is a computer system.

16. A method for acoustic testing, the method comprising:

forming an array;

detecting noise using the array;

receiving commands to change a size of the array based on the noise detected;

applying heat to a morphable material of a support structure, wherein the support structure physically supports the array;

physically changing the size of the array; and applying cooling elements to the morphable material of the support structure.

17. The method of claim 16, wherein physically changing the size of the array further comprises:

controlling a number of mechanical components to move a number of structural components of the support structure, wherein the support structure physically supports the array.

18. The method of claim 16, wherein application of at least one of:

heat, and cooling elements, to the morphable material deforms the support structure.

19. The method of claim 16, wherein an electrical system is controlled to apply the heat to the morphable material.

20. The method of claim 16, wherein a cooling system is controlled to apply the cooling elements to the morphable material.

21. The method of claim 16, wherein applying at least one of: the heat, and the cooling elements, to maintain a constant temperature of the morphable material maintains a shape of the morphable material.

22. The method of claim 16, wherein physically changing the size of the array further comprises:

adapting the support structure into a number of dimensions.

23. A method for distributing acoustic sensors on a support structure, the method comprising:

forming, using a controller, an array of acoustic sensors in a first pattern;

receiving commands from the controller;

changing, based upon the commands, the first pattern of the array to a selected pattern from a number of patterns, such that changing the first pattern comprises changing a distance between a first acoustic sensor and a second acoustic sensor, in the acoustic sensors;

physically changing a shape of the support structure, using the controller, and achieving the selected pattern for the array; and subsequently distinguishing, using the acoustic sensors, a noise source.

24. An apparatus for adapting an acoustic array, the apparatus comprising:

a structure having a shape configured to change in a number of dimensions, wherein the shape of the structure is changed in the number of dimensions during an acoustic test, wherein the structure is comprised of at least one of a number of structural components, a number of flexible components, and a morphable material, wherein the number of structural components include at least one of rods, tubes, arms, bars, legs, posts, crossbars, racks, nets, and trellis, wherein the number of flexible components include at least one of ball-and-socket joints, tracks, rails, springs, hinges, pulleys, cables, levers, and ratcheting devices, and wherein the morphable material is a shape memory alloy material;

an array of acoustic sensors associated with the structure, configured such that a change in a physical location of the acoustic sensors with respect to each other in the array occurs in response to a structural component in the number of structural components changing, in the number of dimensions, from a previous shape, and wherein changes in the previous shape of the structural component changes at least one of: an aperture size for the array of acoustic sensors, and a spatial resolution for the array of acoustic sensors;

a shape changing system associated with the structure, wherein the shape changing system is configured to cause the structure to change the shape in the number of dimensions; and a controller in communication with the array of acoustic sensors, wherein the controller is configured to receive data from the array of acoustic sensors and to control the shape changing system.

25. An apparatus for acoustic testing, the apparatus comprising:

a support structure;

a number of acoustic sensors coupled to the support structure, such that the number of acoustic sensors form an array, the support structure configured to: physically change a size of the array, and adapt in a number of dimensions; and a controller, the controller being a computer system, configured to control the support structure to change a physical spatial distribution of the number of acoustic sensors, such that a distance between a first acoustic sensor and a second acoustic sensor, in the number of acoustic sensors changes, and the number of acoustic sensors comprise a capacity to distinguish a noise source after the change to the spatial distribution of the number of acoustic sensors.

26. A method for acoustic testing with a physically variable acoustic array, the method comprising:

forming an array detecting noise using the array;

receiving commands from a controller, to change a size of the array based on the noise detected;

controlling at least one of a number of mechanical components, an electrical system, and a cooling system, wherein the number of mechanical components are configured to move a number of structural components of a support structure, such that the support structure physically supports the array, such that the electrical system is configured to apply heat to a morphable material of the support structure, wherein the cooling system is configured to apply cooling elements to the morphable material, such that application of at least one of the heat and the cooling elements to the morphable material deforms the support structure, and wherein controlling at least one of the electrical system and the cooling system to maintain a constant temperature of the morphable material maintains a shape of the support structure;

adapting the support structure into a number of dimensions; and physically changing the size of the array.

* * * * *